US008523474B2

(12) United States Patent
Liu

(10) Patent No.: US 8,523,474 B2
(45) Date of Patent: Sep. 3, 2013

(54) LIQUID DISPENSING DEVICE WITH RATCHET MECHANISM

(75) Inventor: Li-Mei Liu, Guang Dong Province (CN)

(73) Assignee: Allen & Thomas Cosmetic Accessories Co., Ltd., Zhuhai (CN)

( * ) Notice: Subject to any disclaimer, the term of this patent is extended or adjusted under 35 U.S.C. 154(b) by 119 days.

(21) Appl. No.: 13/290,587

(22) Filed: Nov. 7, 2011

(65) Prior Publication Data

US 2013/0112717 A1 May 9, 2013

(51) Int. Cl.
*B43K 5/06* (2006.01)

(52) U.S. Cl.
USPC ..... 401/175; 401/202; 401/269

(58) Field of Classification Search
USPC ..... 401/75, 172–175, 202, 269; 222/386, 222/390
See application file for complete search history.

(56) References Cited

U.S. PATENT DOCUMENTS 4,071,300 A * 1/1978 Nichols et al. ..... 401/175
7,300,221 B2 * 11/2007 Byun ..... 401/286
8,206,050 B2 * 6/2012 Prague ..... 401/175

* cited by examiner

*Primary Examiner* — David Walczak

(57) ABSTRACT

A liquid dispensing device with ratchet is provided with a container, a transmission assembly, a dispensing assembly, and a cap. A pulling of the cap away from the container bounces a carrier and unblocks an inlet opening. A further turning of the sleeve toward a predetermined direction co-rotates both the rotation ring and the externally threaded pipe to move the plunger toward bottom of the container along the externally threaded pipe in order to push the liquid to flow to the application head via the channel, the inlet opening, and the passage.

6 Claims, 6 Drawing Sheets

LIQUID DISPENSING DEVICE WITH RATCHET MECHANISM

BACKGROUND OF THE INVENTION

1. Field of the Invention

The invention relates to liquid dispensers and more particularly to a liquid (e.g., lotion) dispensing device having a ratchet mechanism so that a dispensing is made possible only by turning the liquid dispensing device, for example, clockwise and further lotion is prevented from leaking after closing the cap after use.

2. Description of Related Art

A conventional liquid (e.g., lotion) dispenser, as a prior work of the present inventor, is shown in FIGS. 5 and 6 and comprises a hollow, cylindrical guide member 81, a sleeve 80 lockingly fastened on the guide member 81, a hollow, cylindrical first container 82 having one end fastened by the guide member 81 and the sleeve 80, and a hollow, cylindrical second container 83 spaced from the first container 82 and having the other end fastened by the guide member 81 and the sleeve 80. For using the second container 83, a person may push the sleeve 80 toward the first container 82 to disengage teeth 801 on an inner surface of the sleeve 80 from teeth 831 on an outer surface of the second container 83 until the teeth 801 are lockingly engaged with teeth 821 on an outer surface of the first container 82. Next, turning the second container 83 may turn a toothed positioning ring 923 which in turn turns a threaded bar 921 engaging through the positioning ring 923. Thus, the threaded bar 921 moves to push a plunger 922 which in turn pushes out lotion contained in the second container 83 out of a second application head 830 of the second container 83 to, for example, the face of the person for dispensing.

While the conventional liquid dispensers continue to enjoy market success, a number of drawbacks have been found by the present inventor. For example, the container and the application head thereof always communicate each other. Thus, lotion remained on the application head may flow back into the container after use. This can contaminate lotion stored in the container. Further, no leak proof means is provided to each container. Hence, lotion may leak out of the container when shaking the liquid dispenser. Furthermore, both the first and second containers can be turned clockwise or counterclockwise. But only a clockwise turning of the container can dispense lotion. This, however, may jam the components of the liquid dispenser or even cause damage to the liquid dispenser if a person turns the container counterclockwise due to carelessness or other reasons. Thus, the need for improvement still exists.

SUMMARY OF THE INVENTION

It is therefore one object of the invention to provide a liquid dispensing device comprising a container comprising a space for containing a quantity of liquid, and a pawl member on a projecting opening; a transmission assembly disposed in the space and comprising a sleeve, a rotation ring fastened in the sleeve, an externally threaded pipe, and an internally threaded plunger wherein the rotation ring comprises a ratchet wheel, the sleeve is rotatably secured onto the container by engaging the ratchet wheel with the pawl member, one bare end of the externally threaded pipe is partially retained in the rotation ring, the plunger is engagement secured to the externally threaded pipe, and the externally threaded pipe comprises an axial channel; a dispensing assembly comprising a hollow mounting member, an elongated hollow carrier, an application head, and an exterior case wherein the mounting member is partially disposed in the sleeve and comprises an inlet opening at one end, the carrier comprises an axial passage and is capable of axially moving in the mounting member in a predetermined range, and the application head is partially anchored in both the carrier and the exterior case which is disposed at one end of the carrier distal the mounting member; and a cap comprising a capping section on an inner surface proximate its open end and a locking section extending inward from the capping section distal the open end wherein in a closed state of the container, a forward portion of the sleeve is lockingly, sealingly concealed by the capping section and the carrier is lockingly, sealingly concealed by the locking section; wherein a pulling of the cap away from the container bounces the carrier outward due to removal of a force exerted by the locking section on the carrier, and unblocks the inlet opening; and wherein a turning of the sleeve toward a predetermined direction co-rotates both the rotation ring and the externally threaded pipe to move the plunger toward bottom of the container along the externally threaded pipe in order to push the liquid to flow to the application head via the channel, the inlet opening, and the passage.

The above and other objects, features and advantages of the invention will become apparent from the following detailed description taken with the accompanying drawings.

DETAILED DESCRIPTION OF THE INVENTION

Figure 1:
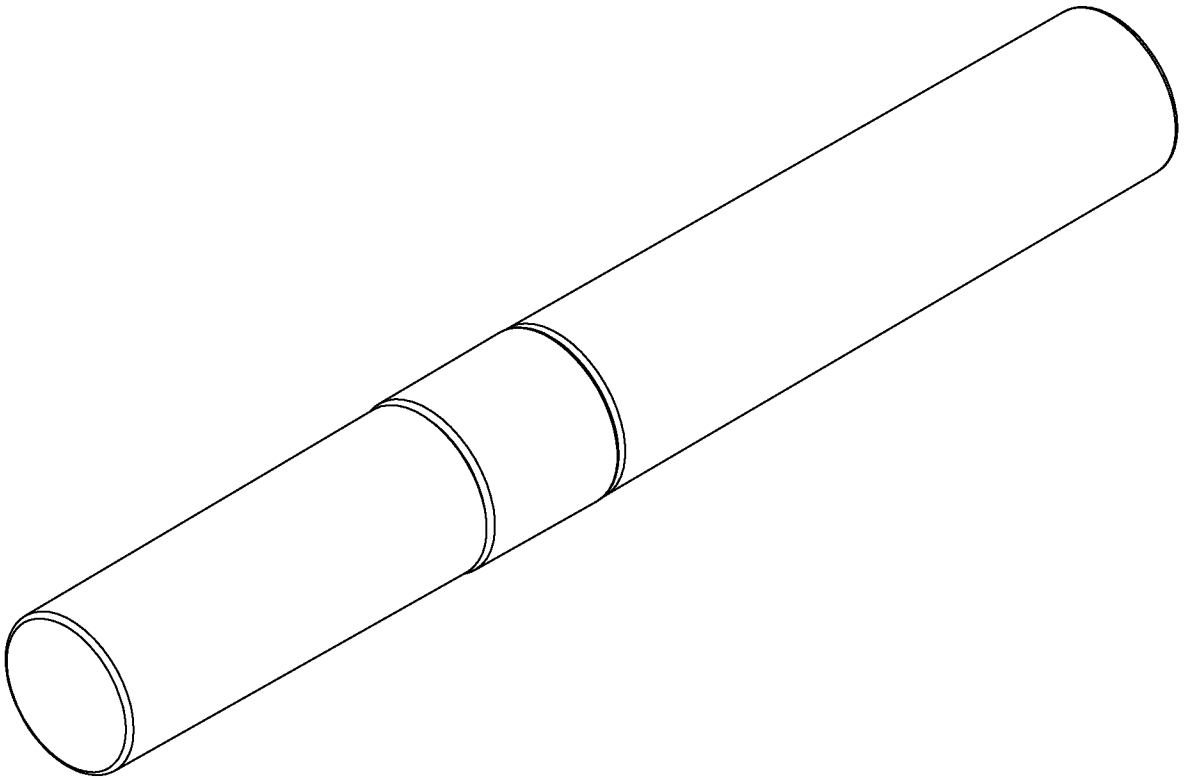
FIG. 1 is a perspective view of a liquid dispense according to the invention.
Figure 2:
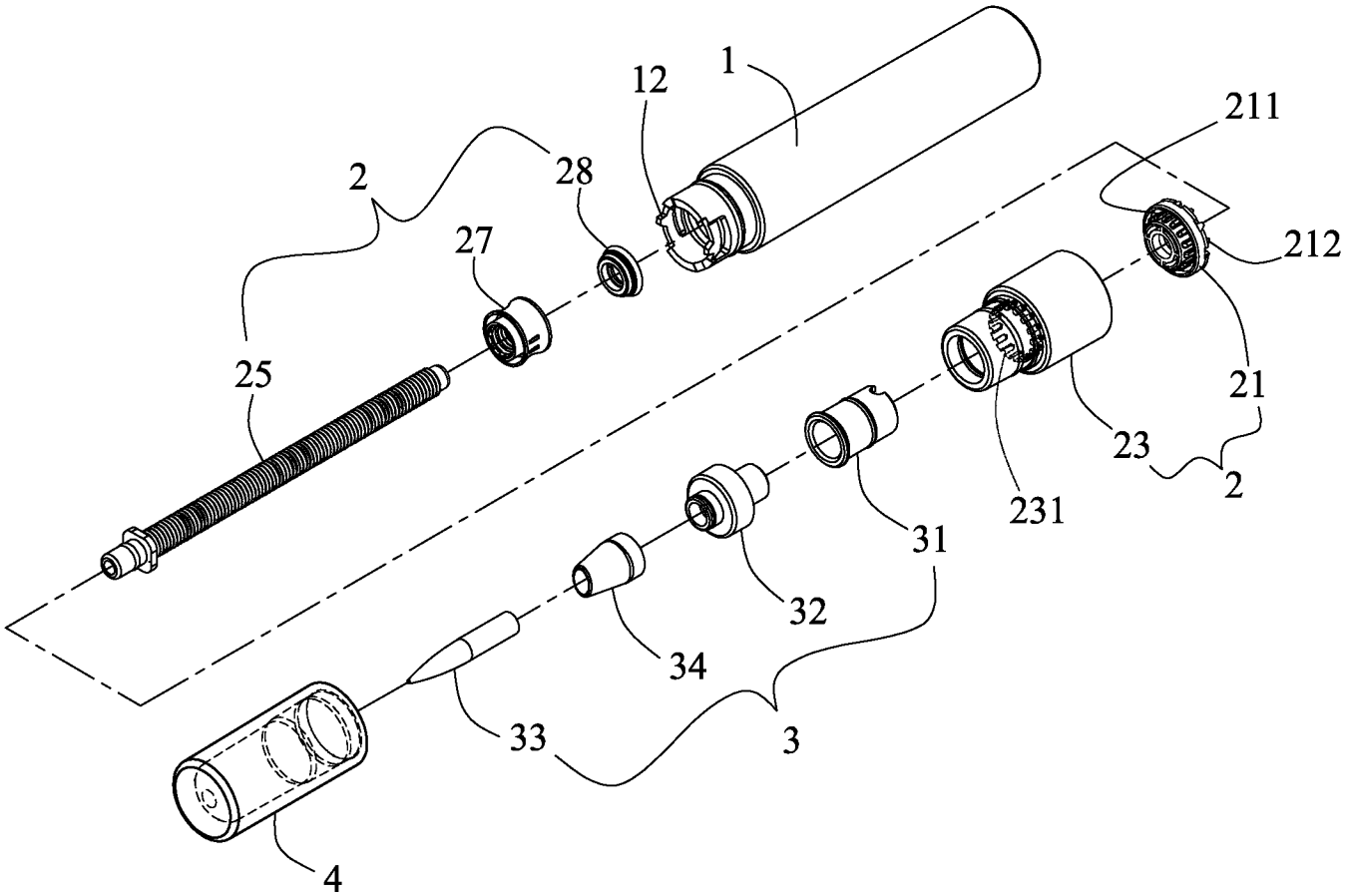
FIG. 2 is an exploded view of FIG. 1.

Referring to FIGS. 1 to 4, a liquid dispenser in accordance with the invention comprises the following components as discussed in detail below.

A cylindrical container 1 has a closed bottom and comprises a space 11 for containing a quantity of lotion, and a pawl member 12 on a projecting opening distal the bottom.

A transmission assembly 2 is disposed in the space 11 and comprises a sleeve 23, a rotation ring 21 in the sleeve 23, an externally threaded pipe 25, a plunger 27, and a sealing ring 28. The sleeve 23 is rotatably secured onto the pawl member 12 and adapted to turn about the container 1. The sleeve 23 comprises internal teeth 231 on an inner surface. The rotation ring 21 comprises an externally toothed section 211 at one end adapted to engagement secure to the internal teeth 231 to anchor the rotation ring 21 within the sleeve 23. One bare end of the externally threaded pipe 25 is partially retained in the rotation ring 21. The sealing ring 28 is put on the externally threaded pipe 25 adjacent one end of the externally threaded pipe 25. The plunger 27 is put on both the externally threaded pipe 25 and the sealing ring 28. Both the plunger 27 and the sealing ring 28 have internal teeth engagement secured to the threads of the externally threaded pipe 25 so that lotion stored in the container 1 is prevented from flowing out of the container 1 through the surface of the externally threaded pipe 25 contacting both the plunger 27 and the sealing ring 28. The externally threaded pipe 25 comprises an axial channel 251. Both the sleeve 23 and the rotation ring 21 may co-rotate to turn the externally threaded pipe 25. The plunger 27 is sealingly engaged with the inner surface of the space 11. Further, both the plunger 27 and the sealing ring 28 may move axially toward bottom of the space 11 by engagement moving along the externally threaded pipe 25. The rotation ring 21 further comprises a ratchet wheel 212 on the other end. The ratchet wheel 212 is engaged with the pawl member 12 together they form a ratchet so that the rotation ring 21 is allowed to turn in only one direction about the container 1.

Figure 3:
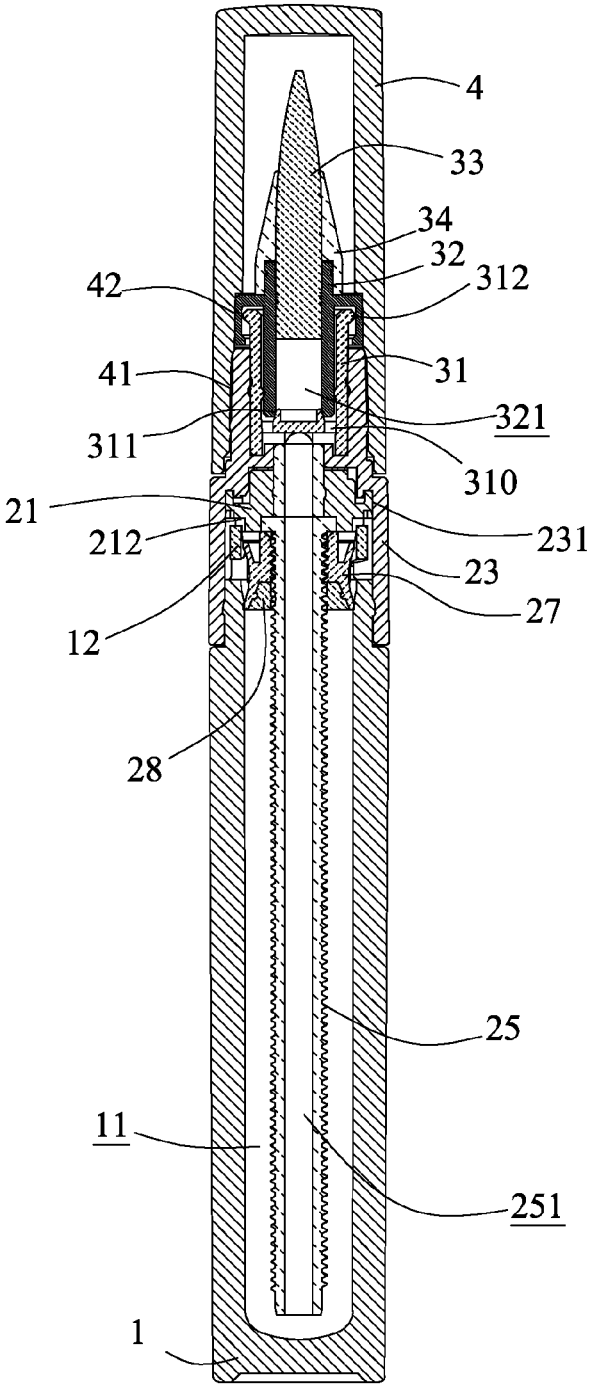
FIG. 3 is a longitudinal sectional view of FIG. 1.
Figure 4:
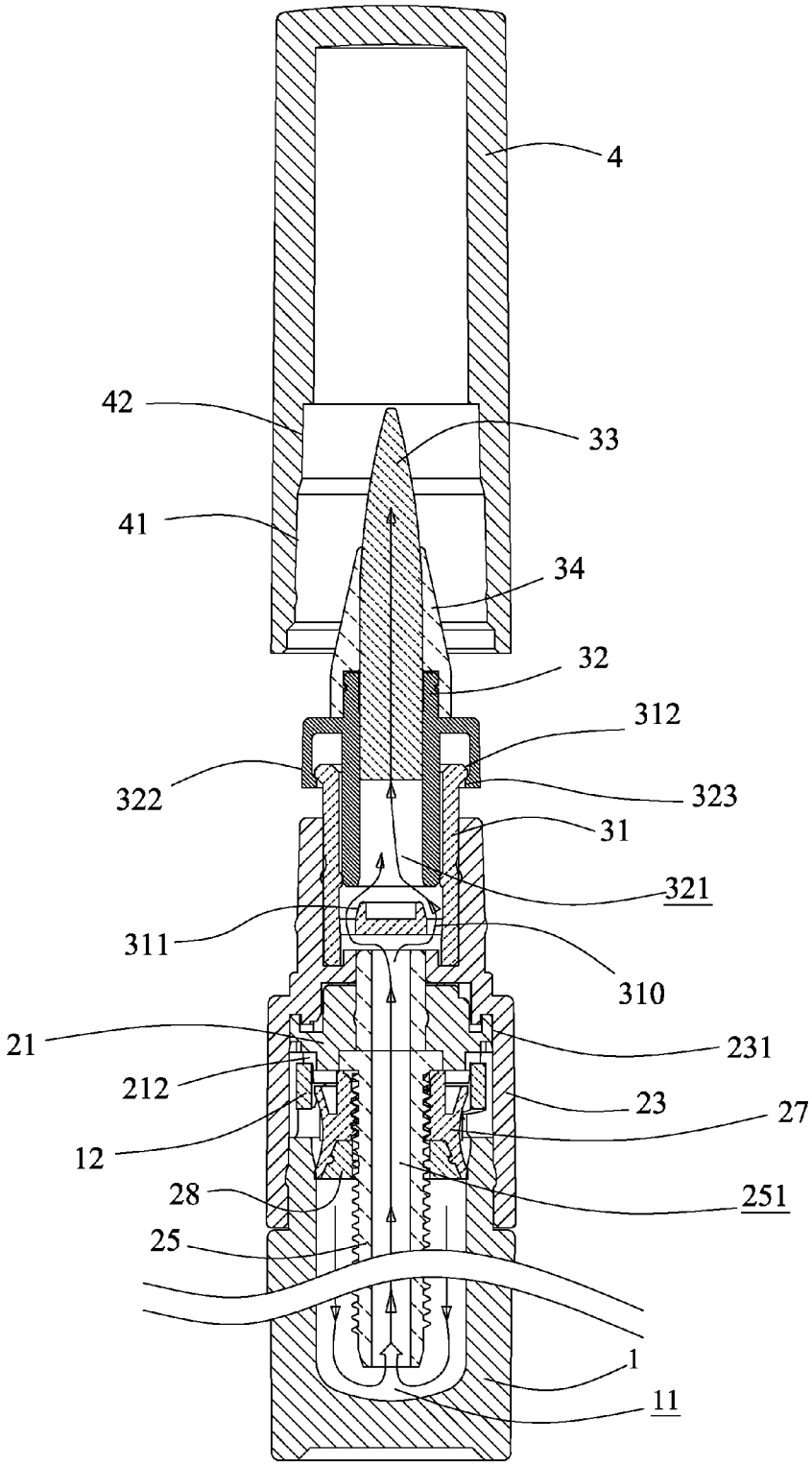
FIG. 4 is a view similar to FIG. 3 where the cap is dislodged and lotion is flowing out of the application head for dispensing.
Figure 5:
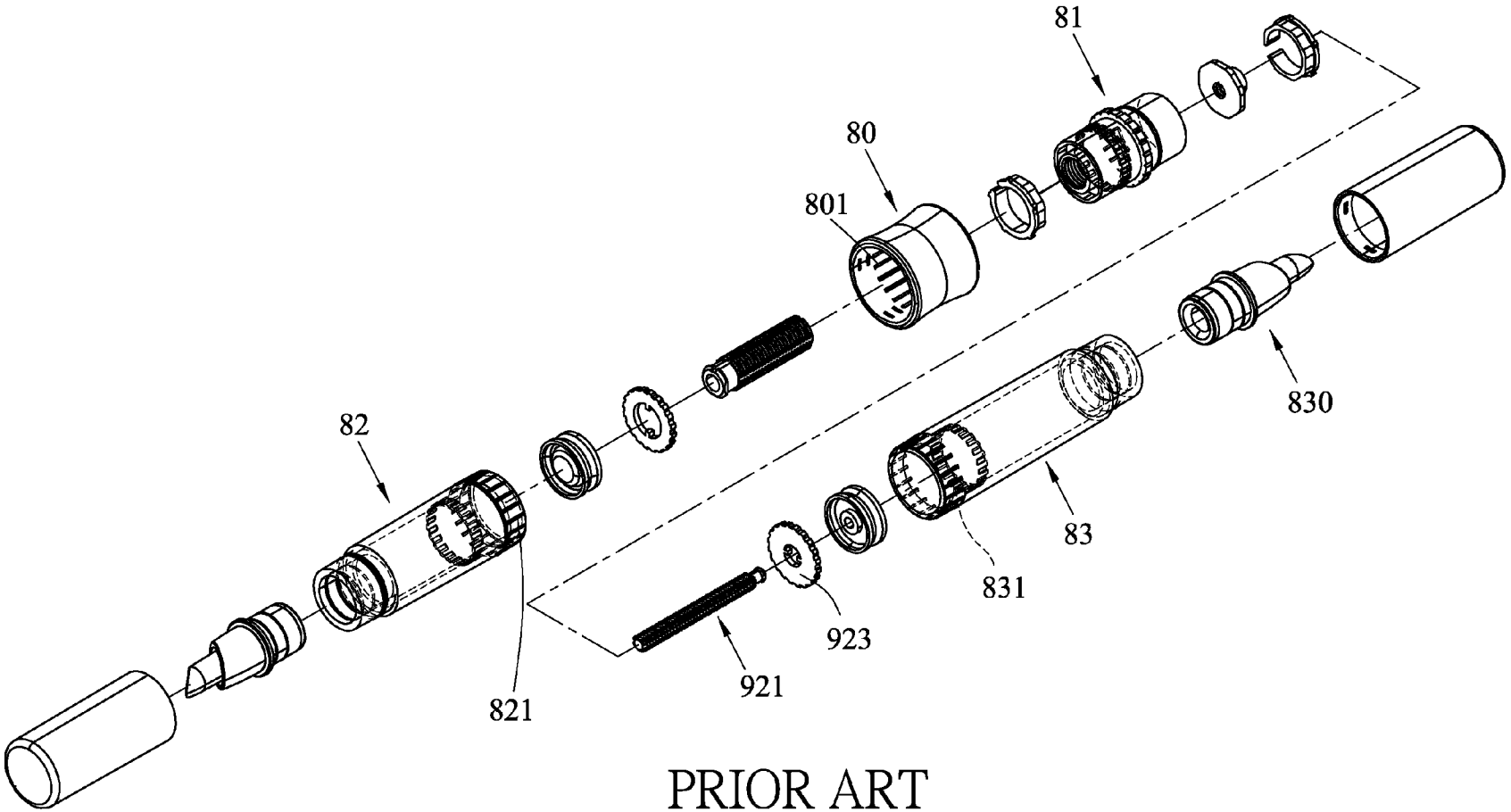
PRIOR ART FIG. 5
FIG. 5 is an exploded view of a conventional liquid dispenser.
Figure 6:
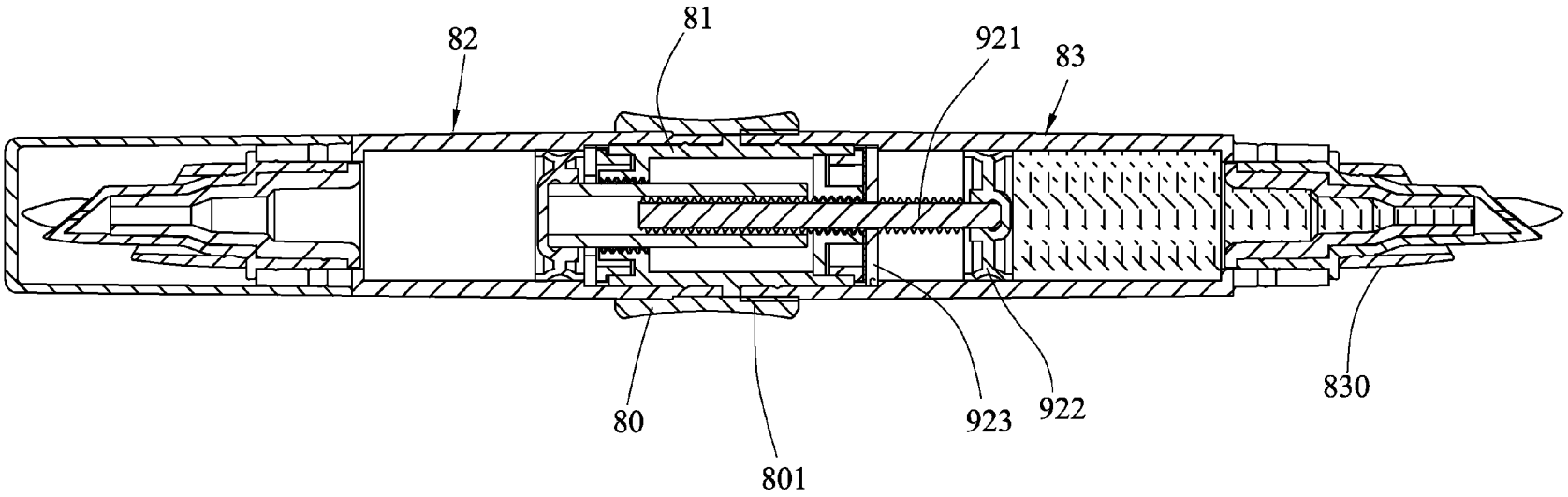
PRIOR ART FIG. 6
FIG. 6 is a longitudinal sectional view of the liquid dispenser shown in FIG. 5.

A dispensing assembly 3 comprises a hollow, cylindrical mounting member 31, an elongated hollow carrier 32, an application head 33, and a hollow, conic exterior case 34. The mounting member 31 is partially disposed in the sleeve 23 and comprises an inlet opening 310 at one end and an outwardly extending rim 312 on the other end. The carrier 32 comprises an axial passage 321, a shroud 322 extending outward and toward the mounting member 31 for receipt a portion of the mounting member 31 not disposed in the sleeve 23, and an inward extending annular stop member 323. The carrier 32 may axially move in the mounting member 31 in a range from the rim 312 contacting the blind end of the shroud 322 to the position when the rim 312 contacts the stop member 323 and being stopped by the stop member 323 (i.e., preventing the carrier 32 from disengaging from the mounting member 31). The bullet shaped application head 33 is partially anchored in both the carrier 32 and the exterior case 34 which is disposed at one end of the carrier 32 distal the mounting member 31. The application head 33 is either a sponge or a brush. The mounting member 31 comprises an internal block member 311 proximate the bottom end. The carrier 32 may axially move to have its bottom end (i.e., passage 321) not being sealed by the block member 311 in an open state of the liquid dispenser as shown in FIG. 4 (i.e., the inlet opening 310 being not blocked). Alternatively, the bottom end of the carrier 32 is blocked by the block member 311 when the liquid dispenser is closed as shown in FIG. 3 (i.e., the inlet opening 310 being blocked). As a result, lotion contained in the container 1 is prevented from leaking.

A cup-shaped cap 4 comprises on its inner surface a capping section 41 proximate its open end and a locking section 42 extending inward from the capping section 41 a short distance. In a closed state of the liquid dispenser, a forward portion of the sleeve 23 is lockingly, sealingly concealed by the capping section 41 and the shroud 322 is lockingly, sealingly concealed by the locking section 42 (see FIG. 3). As such, the carrier 32 is retained. To the contrary, a removal of the cap 4 can pull the carrier 32 away from the sleeve 23 a short distance until the rim 312 contacts the stop member 323 and being stopped by the stop member 323 (see FIG. 4). As a result, the inlet opening 310 is open.

As shown in FIG. 4, for opening the liquid dispenser a person may pull the cap 4 away from the sleeve 23. And in turn, the carrier 32 bounces outward due to the removal of the force exerted by the locking section 42 on the carrier 32. Thus, the passage 321 disengages from the block member 311 to communicate with the inlet opening 310. The bouncing of the carrier 32 will be stopped when the shroud 322 contacts the rim 312. Next, the person may turn the sleeve 23 toward a predetermined direction (i.e., allowed direction such as clockwise direction). And in turn, the rotation ring 21 co-rotates with the externally threaded pipe 25. Then both the plunger 27 and the sealing ring 28 move toward bottom of the container 1 along the externally threaded pipe 25. And in turn, lotion contained in the space 11 is pushed to flow to the application head 33 via the channel 251, the inlet opening 310, and the passage 321 as indicated by arrows. The person may apply pushed out lotion to his or her body. It is envisaged by the invention that the sleeve 23 is allowed to turn about the container 1 in only one direction (e.g., clockwise direction) due to the ratchet engagement of the ratchet wheel 212 and the pawl member 12. The amount of pushed out lotion for dispensing can be fairly controlled when turning the sleeve 23.

After use, the person may close the cap 4 onto the sleeve 23 as shown in FIG. 3. Thus, the carrier 32 is pressed toward the sleeve 23 due to the force exerted thereon by the locking section 42. As such, the passage 321 engages the block member 311 to block the flow from the inlet opening 310 to the passage 321. As a result, lotion in the space 11 is prevented from leaking into the application head 33 via the inlet opening 310.

While the invention has been described in terms of preferred embodiments, those skilled in the art will recognize that the invention can be practiced with modifications within the spirit and scope of the appended claims.

What is claimed is:

1. A liquid dispensing device comprising:

a container comprising a space for containing a quantity of liquid, and a pawl member on a projecting opening;

a transmission assembly disposed in the space and comprising a sleeve, a rotation ring fastened in the sleeve, an externally threaded pipe, and an internally threaded plunger wherein the rotation ring comprises a ratchet wheel, the sleeve is rotatably secured onto the container by engaging the ratchet wheel with the pawl member, one bare end of the externally threaded pipe is partially retained in the rotation ring, the plunger is engagement secured to the externally threaded pipe, and the externally threaded pipe comprises an axial channel;

a dispensing assembly comprising a hollow mounting member, an elongated hollow carrier, an application head, and an exterior case wherein the mounting member is partially disposed in the sleeve and comprises an inlet opening at one end, the carrier comprises an axial passage and is capable of axially moving in the mounting member in a predetermined range, and the application head is partially anchored in both the carrier and the exterior case which is disposed at one end of the carrier distal the mounting member; and a cap comprising a capping section on an inner surface proximate its open end and a locking section extending inward from the capping section distal the open end wherein in a closed state of the container, a forward portion of the sleeve is lockingly, sealingly concealed by the capping section and the carrier is lockingly, sealingly concealed by the locking section;

wherein in the closed state of the container the inlet opening is blocked;

wherein a pulling of the cap away from the container bounces the carrier outward due to removal of a force exerted by the locking section on the carrier, and unblocks the inlet opening; and wherein a turning of the sleeve toward a predetermined direction co-rotates both the rotation ring and the externally threaded pipe to move the plunger toward bottom of the container along the externally threaded pipe in order to push the liquid to flow to the application head via the channel, the inlet opening, and the passage.

2. The liquid dispensing device of claim 1, wherein the sleeve comprises internal teeth on an inner surface, and wherein the rotation ring comprises an externally toothed section engagement secured to the internal teeth of the sleeve to retain the rotation ring within the sleeve.

3. The liquid dispensing device of claim 1, wherein the mounting member comprises an internal block member proximate its bottom end, and wherein the carrier is capable of axially moving to have the passage being either sealed by the block member or not.

4. The liquid dispensing device of claim 1, wherein the application head is either a sponge or a brush.

5. The liquid dispensing device of claim 1, wherein the mounting member further comprises an outwardly extending rim opposite to the inlet opening, wherein the carrier further comprises a shroud extending outward and toward the mounting member for receipt a portion of the mounting member not disposed in the sleeve, and an inward extending annular stop member, and wherein the carrier is capable of axially moving in the mounting member in the predetermined range from the rim contacting a blind end of the shroud to a position when the rim contacts the stop member so that the carrier is prevented from disengaging from the mounting member.

6. The liquid dispensing device of claim 1, further comprising an internally threaded sealing ring put on the externally threaded pipe adjacent one end of the externally threaded pipe, and wherein the plunger is further put on the sealing ring.

* * * * *